US009698494B2

(12) United States Patent
Bi et al.

(10) Patent No.: US 9,698,494 B2
(45) Date of Patent: Jul. 4, 2017

(54) QUADRI-POLARIZED ANTENNA RADIATOR, QUADRI-POLARIZED ANTENNA AND QUADRI-POLARIZED MULTI-ANTENNA ARRAY

(71) Applicant: China Telecom Corporation Limited, Beijing (CN)

(72) Inventors: Qi Bi, Morris Plains, NJ (US); Weiliang Xie, Beijing (CN)

(73) Assignee: China Telecom Corporation Limited, Beijing (CN)

( * ) Notice: Subject to any disclaimer, the term of this patent is extended or adjusted under 35 U.S.C. 154(b) by 162 days.

(21) Appl. No.: 14/588,000

(22) Filed: Dec. 31, 2014

(65) Prior Publication Data

US 2015/0303589 A1 Oct. 22, 2015

Related U.S. Application Data

(63) Continuation of application No. PCT/CN2013/072284, filed on Mar. 7, 2013.

(30) Foreign Application Priority Data

Jul. 5, 2012 (CN) ..... 2012 1 0231562

(51) Int. Cl.
*H01Q 1/40* (2006.01)
*H01Q 21/28* (2006.01)
(Continued)

(52) U.S. Cl.
CPC ..... *H01Q 21/28* (2013.01); *H01Q 1/246* (2013.01); *H01Q 1/405* (2013.01); *H01Q 21/24* (2013.01); *H01Q 21/26* (2013.01)

(58) Field of Classification Search
CPC ..... H01Q 1/241; H01Q 21/26; H01Q 21/24
(Continued)

(56) References Cited

FOREIGN PATENT DOCUMENTS

CN 1599138 A 3/2005
CN 2924816 Y 7/2007
(Continued)

OTHER PUBLICATIONS

International Search Report mailed Jun. 13, 2013 in PCT/CN2013/072284, 2 pages.
(Continued)

*Primary Examiner* — Graham Smith
*Assistant Examiner* — Jae Kim
(74) *Attorney, Agent, or Firm* — Kilpatrick Townsend & Stockton LLP

(57) ABSTRACT

A quadri-polarized antenna oscillator, a quadri-polarized antenna, and a quadri-polarized multi-antenna array are provided. The quadri-polarized antenna oscillator comprises four polarized oscillators, wherein midpoints of the four polarized oscillators are coincident; a polarization direction of a first polarized oscillator is a horizontal direction; a polarization direction of a second polarized oscillator is perpendicular to the horizontal direction; a polarization direction of a third polarized oscillator has a 45° angle with the horizontal direction; and a polarization direction of a fourth polarized oscillator has a −45° angle with the horizontal direction. By integrating four polarized oscillators having different polarization directions into one antenna oscillator, the width of the MIMO multi-antenna is reduced, and the horizontal space between two columns of dual-polarized antennas is not required any more, thus the deployment of LTE and 4G networks are favorably implemented without extra space requirement to the top surface of a base station.

13 Claims, 3 Drawing Sheets

(51) Int. Cl.
*H01Q 21/24* (2006.01)
*H01Q 1/24* (2006.01)
*H01Q 21/26* (2006.01)

(58) Field of Classification Search
USPC ..... 343/873, 893, 897
See application file for complete search history.

(56) References Cited

FOREIGN PATENT DOCUMENTS

| | | | | | |
|---|---|---|---|---|---|
| CN | 101533960 | A | | 9/2009 | |
| CN | 201307640 | Y | * | 9/2009 | ..... H01Q 21/26 |
| CN | 201307640 | Y | | 9/2009 | |
| DE | 10116964 | A1 | | 2/2003 | |
| JP | 2010171820 | A | | 8/2010 | |
| JP | 2011024024 | A | | 2/2011 | |

OTHER PUBLICATIONS

Supplementary European Search Report mailed Jan. 12, 2016 in EP 13813786, 8 pages.
English translation of Office Action mailed May 10, 2016 in JP Patent Application 2015-518797. 2 pages.
English translation of Office Action mailed Sep. 6, 2016 in JP Patent Application 2015-518797. 3 pages.

* cited by examiner

QUADRI-POLARIZED ANTENNA RADIATOR, QUADRI-POLARIZED ANTENNA AND QUADRI-POLARIZED MULTI-ANTENNA ARRAY

CROSS-REFERENCE TO RELATED APPLICATIONS

This application is a continuation application of PCT application PCT/CN2013/072284 entitled "QUADRI-POLARIZED AERIAL OSCILLATOR, QUADRI-POLARIZED AERIAL AND QUADRI-POLARIZED MULTI-AERIAL ARRAY," filed on Mar. 7, 2013, which claims priority to Chinese Patent Application No. 201210231562.8, filed on Jul. 5, 2012, which are herein incorporated by reference in their entirety for all purposes.

TECHNICAL FIELD

The present disclosure relates to the field of communications, and more particularly to a quadri-polarized antenna radiator, a quadri-polarized antenna and a quadri-polarized multi-antenna array.

BACKGROUND

At present, the mobile communication network technique have been developed to the Third Generation (referred to as 3G), and 3G networks are already deployed and commercially used in a large scale in the world. With the continuous popularization and promotion of data services and mobile Internet, international communication standards organizations are establishing the technology standards of Long Term Evolution (referred to as LTE) of the mobile communications, 4G and the like to meet the continuous development and promotion of network technologies and service capabilities. A Multiple Input and Multiple Output (referred to as MIMO) technology becomes one of the most critical core technologies in the LTE and future 4G technology as it is capable of improving a network service rate and link performance by adequately using an independent space propagation path.

At present, most of 2G and 3G networks utilize low-frequency-band resources, e.g., the Global System of Mobile Communication (referred to as GSM) is used in 900 MHz, the Code Division Multiple Access (referred to as CDMA) system is used in 800 MHz, and it is possible that the LTE and 4G will be used in the frequency bands of more than 2 GHz in the future, which means that the signal propagation performance of 2G and 3G networks is better than that of the LTE or 4G systems. Since it has been very difficult to increase the quantity of base stations at present, the network providers generally make a plurality of systems share one base station when deploying the LTE or 4G networks. In such a condition, if it will be sought that the base stations of LTE or 4G systems have the same coverage capability as that of the 2G/3G systems, MIMO multi-antenna technology must be utilized. Therefore, in order to improve the coverage capability of the LTE or 4G systems, it is necessary to increase the quantities of the MIMO antennas of the LTE and 4G systems as much as possible.

In the MIMO multi-antenna technology, a plurality of antennas is needed for signal transmission and reception. In an existing MIMO multi-antenna deployment scheme, a certain horizontal distance is generally spaced among the plurality of antennas so as to achieve multi-antenna signal transmission and reception. However, such a scheme will cause great difficulty for the network deployment of the network providers.

Specifically, for the MIMO antennas, general antenna configuration schemes contain 2×2, 4×2, 4×4 configurations and the like, which means that one base station needs to be configured with 4 antennas for signal transmitting and receiving. But now, in the 2×2 MIMO antenna scheme being a mainstream design, a dual-polarized antenna is generally used, so that the design requirements of the 2×2 MIMO antenna can be met because the dual-polarized antenna has weak correlation in the two polarization directions. The increasing of quantity of antennas makes the combination or diversity processing to signals of antennas be possible, which can improve the system performance greatly. However, for a 4×2 or a 4×4 MIMO antenna, further two antennas are needed besides of above dual-polarized antenna. It is conventional that the two independent dual-polarized antennas are horizontally spaced out a certain distance of 1-10λ (λ is a wavelength of a centre frequency point of a frequency band of the antenna). Although the specific value of the wavelength is related to the wireless propagation environment between a transmitter and a receiver, the distance is set to the larger the better so as to ensure weak correlation. Such a spacing mode in horizontal direction results in that an enough big space of the top surface of the base station is necessary for erecting two sets of antenna installation systems. Meanwhile, during the erecting of antenna installation system, it is necessary to ensure the downward inclination angles of the two horizontally-spaced dual-polarized antennas to be coincident and the quantity of antennas on the top surface of the base station is increased actually due to the horizontally-spaced MIMO antennas, which will increase the difficulty for the network providers to negotiate with the owner of the property for establishing the base station. Therefore, the utilizing of above MIMO antennas with horizontally-spaced mode is difficult in actual network construction and deployment to some extent.

The high attention of people to electromagnetic radiation problem results in that the quantity of independent physical antennas is hard to be increased in the site locations of many base stations and it is difficult for many base stations to have enough space to ensure the horizontally-spaced distance of a plurality of antennas, particularly when it is required to install 4 and more MIMO antennas. Therefore, the scheme adopting a plurality of physical antennas is not conducive to the deployment of the LTE and 4G networks.

SUMMARY

The disclosure is directed to a quadri-polarized antenna radiator, a quadri-polarized antenna and a quadri-polarized multi-antenna array. By integrating four polarized radiators having different polarization directions to one antenna radiator, the width of the MIMO multi-antenna is reduced and the horizontal spacing distance between two columns of dual-polarized antennas is not required any more, thus the deployment of LTE and 4G networks can be favourably implemented without extra space requirement to the top surface of a base station.

One aspect of the disclosure is a quadri-polarized antenna radiator comprising four polarized radiators, in which midpoints of said four polarized radiators are coincident, a polarization direction of a first polarized radiator is a horizontal direction, a polarization direction of a second polarized radiator is perpendicular to the horizontal direction, a polarization direction of a third polarized radiator has a 45° angle with the horizontal direction; and a polarization direction of a fourth polarized radiator has a −45° angle with the horizontal direction.

Another aspect of the disclosure is a quadri-polarized antenna comprising at least one quadri-polarized antenna radiator, as described above, arranged in a longitudinal direction, and the polarized radiators with one same polarization direction together constitute a polarized antenna in said polarization direction, in which the quadri-polarized antenna comprises four polarized antennas, wherein a polarization direction of a first polarized antenna is a horizontal direction, a polarization direction of a second polarized antenna is perpendicular to the horizontal direction, a polarization direction of a third polarized antenna has a 45° angle with the horizontal direction, and a polarization direction of a fourth polarized antenna has a −45° angle with the horizontal direction.

Preferably, a spacing distance between two adjacent quadri-polarized antenna radiators is 0.5λ~1λ when the quantity of the quadri-polarized antenna radiators is more than 1, wherein λ is a wavelength of a centre frequency point of a frequency band of the quadri-polarized antenna.

Preferably, for an uplink receiving system, each of the polarized antennas is capable of being used for uplink receiving processing.

Preferably, for a downlink single-transmitting system, a priority level of the second polarized antenna is the highest, and a priority level of the first polarized antenna is the lowest.

Preferably, for a downlink dual-transmitting MIMO system, a priority level of the third polarized antenna and a priority level of the fourth polarized antenna are the highest, and a priority level of the first polarized antenna is the lowest.

Another aspect of the present disclosure is a quadri-polarized multi-antenna array comprising at least two horizontally arranged quadri-polarized antennas as described above, and a horizontal spacing distance between two adjacent quadri-polarized antennas is more than 0.5λ, in which λ is a wavelength of a centre frequency point of a frequency band of the quadric-polarized antennas.

Preferably, the quadri-polarized antenna array is capable of being encapsulated into a physical antenna cover to form single one physical antenna.

In the present disclosure, by integrating four polarized radiators having different polarization directions into one antenna radiator, the width of the MIMO multi-antenna is reduced and the horizontal space between two columns of dual-polarized antennas is not required any more, thus the deployment of LTE and 4G networks are favourably implemented without extra space requirement to the top surface of a base station.

BRIEF DESCRIPTION OF THE DRAWINGS

The accompanying drawings are included to provide a further understanding and are incorporated in and constitute a part of this specification. It is to be understood that both the foregoing general description and the following Detailed Description are merely exemplary and are intended to provide an overview or framework for understanding the nature and character of the claims, rather than to limiting the present disclosure inappropriately, in which:

DETAILED DESCRIPTION OF THE INVENTION

The present disclosure will be further illustrated below in details in conjunction with the accompanying drawings and the embodiments.

Figure 1:
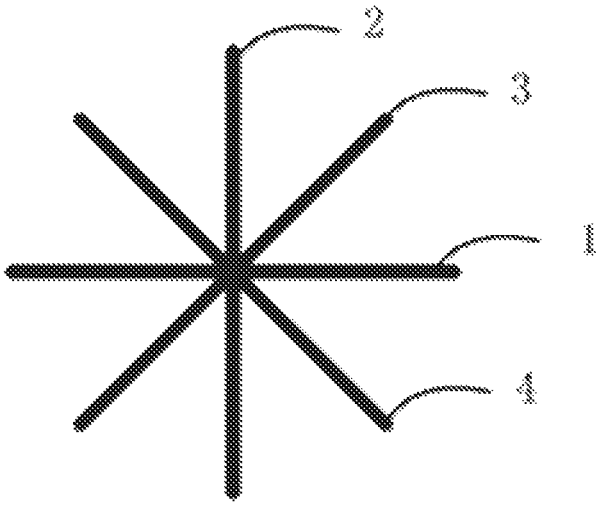
FIG. 1 is the schematic diagram of one embodiment of a quadri-polarized antenna radiator according to the disclosure.

FIG. 1 is the schematic diagram of one embodiment of a quadri-polarized antenna radiator in the present disclosure. As shown in FIG. 1, the quadri-polarized antenna radiator comprises four polarized radiators, wherein midpoints of the four polarized radiators are coincident, a polarization direction of a first polarized radiator 1 is a horizontal direction, a polarization direction of a second polarized radiator 2 is perpendicular to the horizontal direction, a polarization direction of a third polarized radiator 3 has a 45° angle with the horizontal direction, and a polarization direction of a fourth polarized radiator 4 has a −45° angle with the horizontal direction.

On the basis of the quadri-polarized antenna radiator as illustrated above, four polarized radiators are integrated to one antenna radiator, wherein midpoints of the four polarized radiators are coincident, a polarization direction of a first polarized radiator is a horizontal direction, a polarization direction of a second polarized radiator is perpendicular to the horizontal direction, a polarization direction of a third polarized radiator has a 45° angle with the horizontal direction; and a polarization direction of a fourth polarized radiator has a −45° angle with the horizontal direction. By integrating four polarized radiators having different polarization directions into one antenna radiator, the width of the MIMO multi-antenna is reduced and the horizontal space between two columns of dual-polarized antennas is not required any more, thus the deployment of LTE and 4G networks can be favourably implemented without extra space requirement to the top surface of a base station.

Preferably, the four polarized radiators in the quadri-polarized antenna radiator may be arranged in one same plane or different planes. For example, the first and the second polarized radiators may be arranged in one plane, and the third and the fourth polarized radiators may be arranged in another plane.

Figure 2:
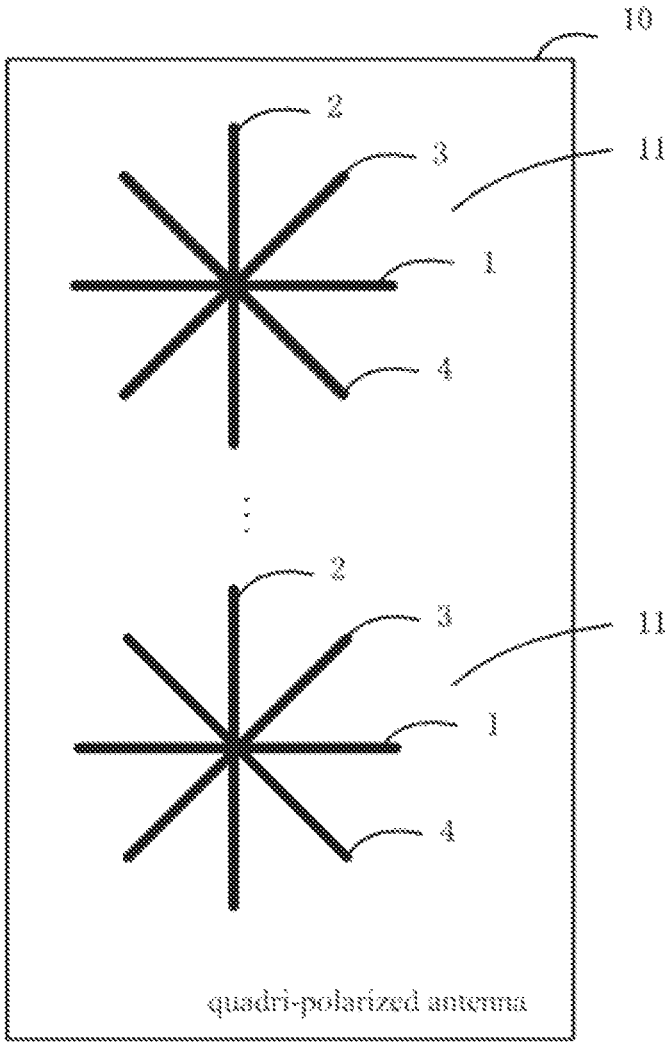
FIG. 2 is the schematic diagram of one embodiment of a quadri-polarized antenna according to the disclosure.

FIG. 2 is the schematic diagram of one embodiment of the quadri-polarized antenna in the present disclosure. As shown in FIG. 2, the quadri-polarized antenna 10 comprises at least one quadri-polarized antenna radiator 11 arranged in a longitudinal direction. The quadri-polarized antenna radiator is the quadri-polarized antenna radiator shown in FIG. 1, and the polarized radiators with one same polarization direction together constitute a polarized antenna in the polarization direction.

The quadri-polarized antenna comprises four polarized antennas, a polarization direction of a first polarized antenna is a horizontal direction, a polarization direction of a second polarized antenna is perpendicular to the horizontal direction, a polarization direction of a third polarized antenna has a 45° angle with the horizontal direction, and a polarization direction of a fourth polarized antenna has a −45° angle with the horizontal direction.

On the basis of the quadri-polarized antenna as illustrated above, the quadri-polarized antenna comprises at least one quadri-polarized antenna radiator arranged in a longitudinal direction and the polarized antenna radiators with one same polarized direction together constitute a polarized antenna in said polarization direction. Therefore, the quadri-polarized antenna comprises four polarized antennas, a polarization direction of a first polarized antenna is a horizontal direction, a polarization direction of a second polarized antenna is perpendicular to the horizontal direction, a polarization direction of a third polarized antenna has a 45° angle with the horizontal direction, and a polarization direction of a fourth polarized antenna has a −45° angle with the horizontal direction. By integrating four polarized antenna having different polarization directions to one antenna, the width of the antenna is reduced and the horizontal space between two columns of dual-polarized antennas is not required any more, thus the deployment of LTE and 4G networks are favourably implemented without extra space requirement to the top surface of a base station.

The quantity of the quadri-polarized antenna radiators in one quadri-polarized antenna may be set according to the gain requirements of the antenna. Preferably, in one quadri-polarized antenna, the spacing distance between two adjacent quadri-polarized antenna radiators is set to 0.5λ~1λ, wherein λ is a wavelength of the centre frequency point of a frequency band of the quadri-polarized antenna.

When the quadri-polarized antenna is used in an LTE system, a specific transmitting and receiving scheme should be considered. For an uplink receiving system, an uplink signal can be received by each antenna and an uplink receiving processing unit in a base station can combine the uplink signals received by each antenna, so an uplink multi-antenna processing gain can be obtained. Therefore, each polarized antenna in the quadri-polarized antenna can be used for uplink receiving processing.

For a downlink transmitting system, in view of the limited processing capability of LTE terminals and power consumption problem, most of LTE terminals currently only support MIMO antennas with a dimensionality of 2. It means that the quantity of the antennas for downlink transmitting is less than that of the antennas for uplink receiving in existing LTE system, so the priority should be set for the antennas for downlink transmitting. Based on an analysis on the propagation characteristics of wireless signal, because the propagation characteristic of horizontally-polarized signal is poor, the priority of the first polarized antenna is the lowest in the antennas for downlink transmitting. For a downlink single-transmitting system, the propagation characteristic of signal polarized in 90° direction is the best, so the priority of the second polarized antenna is the highest and the priority of the first polarized antenna is the lowest. For a downlink dual-transmitting MIMO system, it is required that there is orthogonality between signals in the MIMO system, so the priorities of the third and the fourth polarized antennas are the highest and the priority of the first polarized antenna is the lowest.

Antenna ports may be configured at the bottom of an antenna. Four antenna ports should be set at the bottom of the antenna because the quadri-polarized antenna radiator is adopted, and the four antenna ports correspond to the polarized antennas in four polarization directions respectively.

Figure 3:
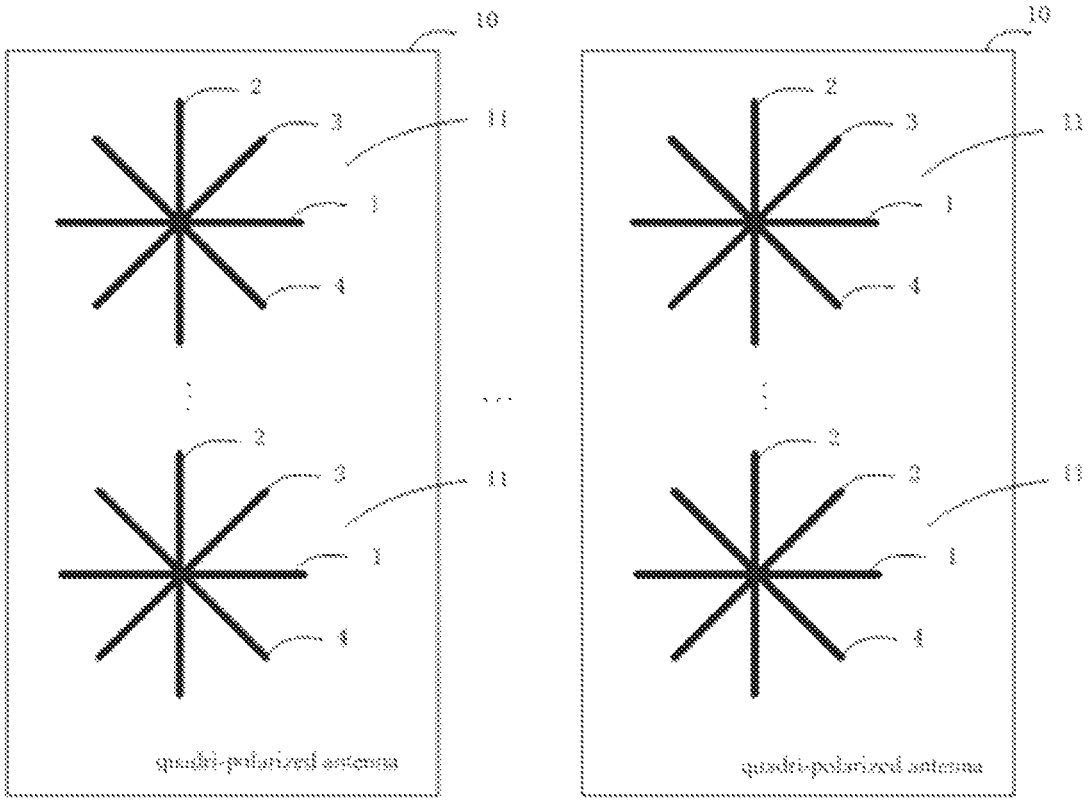
FIG. 3 is the schematic diagram of one embodiment of a quadri-polarized multi-antenna array according to the disclosure.

FIG. 3 is the schematic diagram of one embodiment of the quadri-polarized multi-antenna array in the present disclosure. As shown in FIG. 3, the quadri-polarized multi-antenna array comprises at least two horizontally-arranged quadri-polarized antennas 10. The quadri-polarized antenna 10 is the quadri-polarized antenna illustrated as the embodiment shown in FIG. 2 and a horizontal spacing distance between two adjacent quadri-polarized antennas is more than 0.5λ, wherein λ is a wavelength of a centre frequency point of a frequency band of the quadri-polarized antennas.

On the basis of the quadri-polarized multi-antenna array as illustrated above, the quadri-polarized multi-antenna array comprises at least two horizontally-arranged quadri-polarized antennas, wherein the quadri-polarized antenna is the quadri-polarized antenna illustrated in above embodiment and a horizontal spacing distance between two adjacent quadri-polarized antennas is more than 0.5λ, wherein λ is a wavelength of a centre frequency point of a frequency band of the quadri-polarized antennas. By integrating four polarized antennas having different polarization directions to one antenna, the width of the antenna is reduced and the horizontal spacing between two columns of dual-polarized antennas is not required any more, thus the deployment of LTE and 4G networks can be favourably implemented without extra space requirement to the top surface of a base station.

Preferably, the quadri-polarized antenna array is capable of being encapsulated into a physical antenna cover to form one physical antenna, which will facilitate the construction and deployment of MIMO multi-antennas much more.

The quadri-polarized multi-antenna according to the present disclosure can avoid isolating multiple antennas with spacing during configuring the MIMO antennas as 4×2 or 4×4 configuration schemes, and can descend the requirement on the horizontal width dimensions of the antennas when configuring the MIMO antennas with more higher configuration.

It will be apparent to those skilled in the art that various modifications to the preferred embodiments of the disclosure as described herein can be made without departing from the spirit or scope of the disclosure as defined in the appended claims. Thus, the disclosure covers the modifications and variations, provided they come within the scope of the appended claims and the equivalents thereto.

What is claimed is:

1. A quadri-polarized antenna, comprising:

four linear polarized radiators having coincident mid-points, wherein the four polarized radiators including a first polarized radiator, a second polarized radiator, a third polarized radiator, and a fourth polarized radiator, wherein:

a polarization direction of the first polarized radiator is a horizontal direction;

a polarization direction of the second polarized radiator is perpendicular to said horizontal direction;

a polarization direction of the third polarized radiator has a 45° angle with said horizontal direction; and a polarization direction of the fourth polarized radiator has a −45° angle with said horizontal direction, and, wherein said polarization directions of the first polarized radiator to the fourth polarized radiator correspond to four different polarization directions of said quadri-polarized antenna respectively, wherein the quadri-polarized antenna is a downlink dual-transmitting multiple-input and multiple-output (MIMO system) antenna, a priority level of said third polarized radiator and a priority level of said fourth polarized radiator are the highest and are higher than priority levels of said first and second polarized radiators, and a priority level of said first polarized radiator is the lowest among said four polarized radiators, the priority level of a respective polarized radiator indicating a priority at which the respective polarized radiator transmits data downlink.

2. The quadri-polarized antenna according to claim 1, wherein:

for an uplink receiving system, each of said polarized radiators is used for uplink reception processing.

3. The quadri-polarized antenna according to claim 1, wherein:

for a downlink single-transmitting system, the priority level of said second polarized radiator is the highest, and the priority level of said first polarized radiator is the lowest.

4. The quadri-polarized antenna according to claim 1, wherein:

a spacing distance between two adjacent quadri-polarized antenna radiators is 0.5λ~1λ when the quantity of said quadri-polarized antenna radiators is greater than 1, wherein λ is a wavelength of a centre frequency point of a frequency band of said antenna.

5. The quadri-polarized antenna according to claim 4, wherein:

for an uplink receiving system, each of said polarized radiators is used for uplink reception processing.

6. The quadri-polarized antenna according to claim 4, wherein:

for a downlink single-transmitting system, the priority level of said second polarized radiator is the highest among said polarized radiators, and the priority level of said first polarized antenna is the lowest among said polarized radiators.

7. A quadri-polarized multi-antenna array, comprising at least two horizontally-arranged quadri-polarized antennas, wherein:

each of said quadri-polarized antennas is the quadri-polarized antenna according to claim 1; and a horizontal spacing distance between two adjacent quadri-polarized antennas in the quadri-polarized multi-antenna array is greater than 0.5λ, wherein λ is a wavelength of a centre frequency point of a frequency band of said antennas.

8. The quadri-polarized multi-antenna array according to claim 7, wherein:

for an uplink receiving system, each of said polarized antennas in the quadri-polarized multi-antenna array is used for uplink reception processing.

9. The quadri-polarized multi-antenna array according to claim 7, wherein:

for a downlink single-transmitting system, a priority level of said second polarized antenna is the highest among all polarized antennas in the quadri-polarized multi-antenna array, and a priority level of said first polarized antenna is the lowest among all polarized antennas in the quadri-polarized multi-antenna array, the priority level of a respective polarized antenna indicating a priority at which the respective polarized antenna transmits data downlink.

10. The quadri-polarized multi-antenna array according to claim 7, wherein:

a spacing distance between two adjacent quadri-polarized radiators in each of said quadri-polarized antennas is 0.5λ~1λ when the quantity of said quadri-polarized radiators in each of said quadri-polarized antennas is greater than 1, wherein λ is a wavelength of a centre frequency point of a frequency band of said antenna.

11. The quadri-polarized multi-antenna array according to claim 10, wherein:

for an uplink receiving system, each of said polarized antennas is used for uplink reception processing.

12. The quadri-polarized multi-antenna array according to claim 10, wherein:

for a downlink single-transmitting system, the priority level of said second polarized antenna is the highest among all polarized antennas in the quadri-polarized multi-antenna array, and the priority level of said first polarized antenna is the lowest among all polarized antennas in the quadri-polarized multi-antenna array.

13. The quadri-polarized multi-antenna array according to claim 7, wherein:

said quadri-polarized antenna array is encapsulated into a physical antenna cover to form single one physical antenna.

* * * * *